US008567213B2

(12) United States Patent
Mak

(10) Patent No.: US 8,567,213 B2
(45) Date of Patent: Oct. 29, 2013

(54) ETHANE RECOVERY METHODS AND CONFIGURATIONS FOR HIGH CARBON DIOXIDE CONTENT FEED GASES

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 544 days.

(21) Appl. No.: 12/300,031

(22) PCT Filed: Jun. 19, 2007

(86) PCT No.: PCT/US2007/014330

§ 371 (c)(1),
(2), (4) Date: Feb. 2, 2009

(87) PCT Pub. No.: WO2007/149463

PCT Pub. Date: Dec. 27, 2007

(65) Prior Publication Data

US 2009/0301133 A1 Dec. 10, 2009

Related U.S. Application Data

(60) Provisional application No. 60/815,549, filed on Jun. 20, 2006.

(51) Int. Cl.
*F25J 3/00* (2006.01)

(52) U.S. Cl.
USPC ..... 62/657; 62/617; 62/618; 62/621; 62/628

(58) Field of Classification Search
USPC ..... 62/617–621, 628, 657, 640, 643, 656
See application file for complete search history.

(56) References Cited

U.S. PATENT DOCUMENTS

| | | | | |
|---|---|---|---|---|
| 3,901,673 | A * | 8/1975 | Zahn et al. | 62/619 |
| 4,251,249 | A * | 2/1981 | Gulsby | 62/621 |
| 4,544,452 | A * | 10/1985 | Halliday et al. | 203/1 |
| 4,901,533 | A * | 2/1990 | Fan et al. | 62/614 |
| 5,881,569 | A * | 3/1999 | Campbell et al. | 62/621 |
| 5,992,175 | A * | 11/1999 | Yao et al. | 62/621 |
| 6,244,070 | B1 * | 6/2001 | Lee et al. | 62/620 |
| 7,051,553 | B2 | 5/2006 | Mak et al. | |
| 2001/0052241 | A1 | 12/2001 | Jain et al. | |
| 2003/0188539 | A1 | 10/2003 | Abras et al. | |
| 2004/0261452 | A1 * | 12/2004 | Mak et al. | 62/620 |
| 2005/0229634 | A1 * | 10/2005 | Huebel et al. | 62/632 |

FOREIGN PATENT DOCUMENTS

EP 370611 A2 * 5/1990

* cited by examiner

*Primary Examiner* — Frantz Jules
*Assistant Examiner* — Henry Crenshaw
(74) *Attorney, Agent, or Firm* — Fish & Associates, PC

(57) ABSTRACT

Ethane is separated from a carbon dioxide-containing feed gas in a demethanizer that receives a rich subcooled reflux stream at very low temperature. Freezing of carbon dioxide is prevented by feeding a temperature-controlled vapor portion of the feed gas to the column, wherein the temperature of the vapor portion is adjusted by routing a portion of the expander discharge through a heat exchanger in response to the tray temperature in the demethanizer. Thus, high separation efficiency is achieved at reduced, or even eliminated carbon dioxide freezing.

15 Claims, 4 Drawing Sheets

ETHANE RECOVERY METHODS AND CONFIGURATIONS FOR HIGH CARBON DIOXIDE CONTENT FEED GASES

This application claims priority to our U.S. provisional patent application with the Ser. No. 60/815,549, which was filed Jun. 20, 2006.

FIELD OF THE INVENTION

The field of the invention is gas processing, and especially gas processing for ethane and/or propane recovery.

BACKGROUND OF THE INVENTION

Numerous expansion processes are commonly used for hydrocarbon liquids recovery in the gas processing industry, and particularly in the recovery of ethane and propane from high pressure feed gas. Where the feed gas pressure is relatively low or contains significant quantity of propane and heavier components, additional external (e.g., propane) refrigeration may also be required.

In most known NGL (natural gas liquids) expander processes, feed gas is cooled to a relatively low temperature to achieve partial condensation, typically by heat exchange with the demethanizer overhead vapor, side reboilers, and/or external propane refrigeration. The so condensed portion containing less volatile components is separated from the vapor portion that is typically split into two portions, with one portion being further chilled and fed to the upper section of the demethanizer while the other portion is letdown in pressure in a turbo-expander and fed to the mid section of the demethanizer. Such known configurations are commonly used for high ethane recovery for feed gas with low to medium $CO_2$ content (less than 2%) and high $C_3$+ content (hydrocarbon compounds with three or more carbon atoms greater than 5%), and are generally not applicable for feed gas with high $CO_2$ content (greater than 2%) and low $C_3$+ content (less than 2% and typically less than 1%). Among other reasons, such known processes have a significant intolerance to $CO_2$ freezing, especially where the $CO_2$ to $C_2$+ (hydrocarbon compounds with two or more carbon atoms) ratio in the feed gas increases.

Moreover, in many expander processes, the residue gas from the fractionation column still contains significant amounts of ethane and propane hydrocarbons that could be further recovered if chilled to an even lower temperature, and/or subjected to another rectification stage. To that end, lower temperature can typically be achieved by a higher expansion ratio across the turbo-expander (by lowering the column pressure and temperature). However, in most known configurations, high ethane recovery in excess of 90% is neither achievable due to $CO_2$ freezing in the demethanizer, nor economically justified due to the high capital cost of the compression equipment and energy costs. In other known NGL processes, relatively high propane recoveries can be achieved for a rich feed gas with relatively high $CO_2$ content as very low demethanizer temperatures are not required due to the dilution effect from the presence of heavier hydrocarbons. However, such plants are then limited to a relatively low level of ethane recovery of typically 40%, or even less.

Consequently, known expander processes typically only handle feed gases with low $CO_2$ content and rich feed gases where high propane, and especially high ethane recoveries are desirable. Where needed, a $CO_2$ removal unit (e.g. MDEA treating) can be installed to allow feed gases with elevated CO2 content. However, such approach adds significant cost to the NGL recovery plant. Moreover, most of the known processes are also problematic when the $CO_2$ content in the feed gas gradually increases over time, as such processes often become inoperable due to $CO_2$ freezing in the demethanizer.

Exemplary NGL recovery plants with a turbo-expander, feed gas chiller, separators, and a refluxed demethanizer are described, for example, in U.S. Pat. No. 4,854,955 to Campell et al. Here, a configuration with turbo-expansion is employed for ethane recovery in which the demethanizer column overhead vapor is cooled and condensed by an overhead exchanger using refrigeration generated from feed gas chilling. Such additional cooling step condenses most of the propane and heavier components from the column overhead gas, which is later recovered in a separator and returned to the column as reflux. Unfortunately, while high propane recovery can be achieved with such processes, ethane recovery is often limited to less than desirable levels by $CO_2$ freezing in the demethanizer, particularly when processing a high $CO_2$ and lean feed gas.

Most of heretofore known plants require very low temperatures (−100° F. or lower) in the demethanizer in order to achieve a high ethane recovery. Unfortunately, due to the very low temperatures, the $CO_2$ content in the top section of the demethanizer increases, which invariably causes significant internal recycle and accumulation of the $CO_2$ components. Consequently, such configurations (especially when processing lean gases) are prone to $CO_2$ freezing which presents a significant obstacle for continuous operation.

To circumvent the $CO_2$ freezing problems in the demethanizer, several NGL recovery plants have been described that include a $CO_2$ removal process in the NGL fractionation column. For example, U.S. Pat. No. 6,182,469 Campell et al., teaches a configuration in which a portion of the liquid in the top trays of the demethanizer is withdrawn, heated, and returned to the lower section of the column for $CO_2$ removal and control. While this approach can reduce undesirably high $CO_2$ concentrations to some degree, fractionation efficiency of the demethanizer is sacrificed and additional fractionation trays, heating and cooling duties must be added for the extra processing step. In yet another approach, deethanizer overhead vapor is recycled to the mid section of the demethanizer for the removal of $CO_2$ as disclosed in U.S. Pat. No. 6,516,631 to Trebble. Such recycle scheme can also be used to reduce the $CO_2$ content in the NGL product to some degree, but the required energy for the recycle compressor, and additional heating/cooling duties tend to render this scheme uneconomical.

Thus, numerous attempts have been made to improve the efficiency and economy of processes for separating and recovering ethane and heavier natural gas liquids from natural gas and other sources. However, all or almost all of them are complex and fail to achieve economic operation for high ethane recovery for high $CO_2$ feed gases. Therefore, there is still a need to provide improved methods and configurations for natural gas liquids recovery.

SUMMARY OF THE INVENTION

The present invention is directed to plant configurations and methods in which ethane, propane and higher hydrocarbons are efficiently separated from a carbon dioxide-containing feed gas without the need for upstream carbon dioxide removal In preferred plants and methods, refrigeration content of the demethanizer overhead product and subsequent expansion is used to subcool a portion of the preferably unprocessed feed gas to produce a low-temperature reflux, while a portion of the expander discharge is heated by the preferably unprocessed feed gas to form a temperature-controlled column feed. In such plants and methods, a control circuit is coupled to a flow control element and thermal sensor and operated such that heating of the expander discharge is controlled as a function of the $CO_2$ freezing temperature in the demethanizer.

Therefore, in one aspect of the inventive subject matter, plants and methods employ a control circuit that is operationally coupled to (1) a thermal sensor that is thermally coupled to a refluxed demethanizer (preferably located within the top five trays of the demethanizer) and (2) a flow control element, wherein the refluxed demethanizer is configured to receive a temperature-controlled expander discharge. Most preferably, the control circuit is configured such that the flow control element controls a flow volume of a bypass loop from an expander discharge stream through a heat exchanger to thereby form the temperature-controlled expander discharge in response to a temperature sensed by the sensor in the demethanizer trays such that the tray temperatures are controlled to remain above the CO2 freezing temperatures.

Particularly preferred plants and methods further include a separator fluidly coupled between an expander and the demethanizer. The separator is preferably operated such that the expander discharge stream is a vapor portion of an expander discharge. The separator is typically also configured to provide a liquid stream to the demethanizer. Additionally, or alternatively, the heat exchanger is configured to use refrigeration content from the absorber overhead product to cool a portion of the carbon dioxide-containing feed gas, and is further configured to allow cooling of the portion of the carbon dioxide-containing feed gas from a temperature of between −20° F. and 50° F. to a temperature of −100° F. Where desired, a JT-valve or other pressure reduction device may be included that further reduces temperature of the cooled portion of the carbon dioxide-containing feed gas to thereby form a subcooled reflux stream to the demethanizer. Moreover, it is typically preferred that the heat exchanger is configured to provide heat content from a portion of the carbon dioxide-containing feed gas to the flow volume of the bypass loop to so form the temperature-controlled expander discharge.

Various objects, features, aspects and advantages of the present invention will become more apparent from the following detailed description of preferred embodiments of the invention.

DETAILED DESCRIPTION

Figure 1:
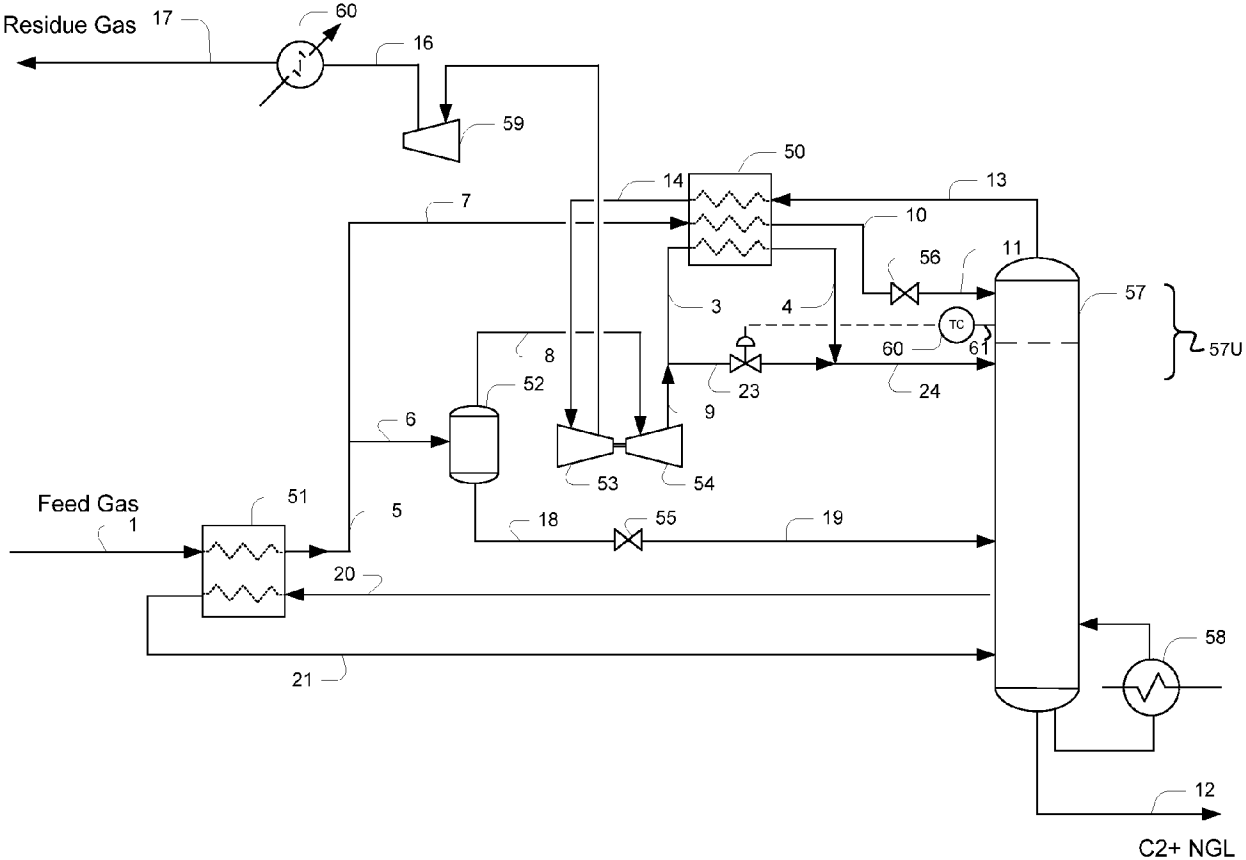
FIG. 1 is a schematic diagram of one exemplary ethane recovery plant.

The inventor has discovered that high ethane and propane recovery can be achieved for a feed gas with relatively high $CO_2$ (and typically low propane plus) content where the NGL plant includes an expander discharge that is heated with heat content of the feed gas to thereby strip $CO_2$ from the NGL and to reduce the demethanizer reflux temperature, while eliminating $CO_2$ freezing in the demethanizer. Most advantageously, and due to the relatively cold reflux, the residue gas compression horsepower is also reduced. Ethane and propane recovery in such plants is typically at least 70% to 90% $C_2$, and at least 95% $C_3$ at a $CO_2$ content equal to or greater than 1%.

Most preferably, the expander discharge is increased in temperature by 5° F. to 15° F. using the heat content of at least a portion of the feed gas (e.g., portion of the vapor fraction of the feed gas, and more typically portion of the feed gas without prior separation) in an amount effective to maintain the demethanizer tray temperature higher than the $CO_2$ freezing temperature (e.g., between 5° F. and 10° F., or more). It should be appreciated that a higher expander discharge temperature to the demethanizer is advantageous in stripping undesirable $CO_2$ from the NGL. At the same time, the refrigeration content of the expander discharge can also be used to lower the demethanizer reflux temperature, which in turn increases ethane and propane recovery, and further lowers residue gas temperature and compression horsepower.

Viewed from a different perspective, it should be recognized that known expander plants are often limited in recovery due to a temperature pinch in the reflux exchanger (in most cases, the temperature approach of the feed gas and the demethanizer overhead heat curves is the limiting factor to high recovery). In contrast, contemplated configurations use the refrigeration content in the expander discharge to open up the temperature approaches, thereby making high recovery possible. As a consequence, contemplated configurations will be effective to remove $CO_2$ from the NGL to low levels (less than 0.5 mol %), which reduces or even eliminates the necessity of downstream $CO_2$ removal.

In yet another aspect of the inventive subject matter, chilled feed gas is typically split into two portions, wherein one portion (and most preferably a vapor fraction thereof) is used to form the expander inlet gas, while the other portion is chilled by the demethanizer overhead vapor to form the subcooled reflux to the demethanizer. In such configurations and methods, it should be recognized that the split ratio of the two portions is varied in conjunction with the expander discharge feed to the demethanizer sub-cooler, and that the ratio control thus dictates the demethanizer tray temperature for desirable ethane recovery and $CO_2$ removal. For example, increasing the flow to the demethanizer reflux exchanger (increase of stream 7 of FIG. 1 relative to stream 6 of FIG. 1) increases the reflux duty, which results in a higher ethane recovery. However, the co-absorbed $CO_2$ must be removed, preferably by increasing the expander discharge flow to the reflux exchanger (increase of stream 3 of FIG. 1 relative to stream 23 of FIG. 1) leading to an increased temperature of the demethanizer trays to a point above the $CO_2$ freezing point. Most advantageously, the ethane/propane recovery increases in such configurations as the temperature of the reflux stream is lowered by the refrigeration content of the expander discharge.

In contrast, the feed gas in heretofore known configurations is typically chilled to a relatively low temperature, typically −20° F. to −50° F. that is then further split into two portions and separately fed to the demethanizer reflux exchanger and the expander. It should be noted that the inefficiency of such configurations arises from the low feed gas temperatures that result in condensing the $CO_2$ vapor inside the demethanizer, which increases the internal recycle of $CO_2$, which in turn builds up $CO_2$ concentration, leading to an undesirable high $CO_2$ content NGL product (e.g. greater than 0.5 mol %).

As used herein in the following examples, the term "about" in conjunction with a numeral refers to a range of that numeral starting from 20% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig. Unless stated otherwise, all percentages refer to mol %.

One exemplary configuration is depicted in FIG. 1 and includes a demethanizer that is coupled to a demethanizer reflux exchanger that is configured to receive the expander discharge, the demethanizer overhead product, and the reflux stream. In such configurations, it should be appreciated that both the overhead product and the expander discharge provide refrigeration to the reflux stream. Therefore, it is especially pointed out that both a colder reflux and a warmer expander discharge stream are provided (as compared to heretofore known configurations), which are used to both increase ethane recovery and decrease $CO_2$ freezing. In most typical embodiments, a bypass stream and temperature control circuit that is coupled to a temperature sensor and flow control element complete the temperature control for the upper section (e.g., second to fifth tray from the top) of the demethanizer. Most preferably, the volume of expander discharge flowing through the bypass stream and the split ratio between reflux stream and expander/column feed are controlled to achieve desirable recovery and avoid $CO_2$ freezing.

Feed gas stream 1, at 40° F. to 100° F. and 600 psig to 1250 psig, is chilled in exchanger 51 to thereby form stream 5, utilizing the refrigeration content of the demethanizer side-draw stream 20 while supplying at least a portion of the reboiler heating duty for stripping the undesirable light components in the demethanizer liquid via stream 21. Optionally, two or more side-draws can be used for even higher efficiency (not shown). Stream 5 is split into two portions, stream 6 and 7, typically at 30% to 60% of stream 5. With respect to the feed gas it is contemplated that in a typical use of contemplated methods and configurations, the feed gas has a relatively high $CO_2$ content (e.g., at least 0.5 mol %, more typically at least 1.0 mol %) and is substantially depleted of $C_4$ (hydrocarbon compounds with four carbon atoms) and heavier components (e.g., total of less than 1.0%, more typically less than 0.8%) with typical composition as shown in Table 1. The table further includes an exemplary overall heat and material balance for a configuration which recovers 89% of the ethane from the feed gas with a 15° F. $CO_2$ freezing margin.

| Mol % | Feed Gas | Residue Gas | Ethane Plus Product |
|---|---|---|---|
| CO2 | 0.72 | 0.42 | 4.19 |
| Nitrogen | 0.50 | 0.54 | 0.00 |
| Methane | 90.51 | 98.24 | 0.01 |
| Ethane | 5.84 | 0.75 | 65.44 |
| Propane | 1.70 | 0.04 | 21.13 |
| i-Butane | 0.25 | 0.00 | 3.15 |
| n-Butane | 0.35 | 0.00 | 4.43 |
| i-Pentane | 0.13 | 0.00 | 1.65 |
| Gas Flow, MMscfd | 1300.1 | 1197.7 | 102.4 |

Stream 6, typically at −20° F. to 50° F., is separated in the expander suction drum 52 into liquid stream 18 and vapor stream 8. Stream 18 may be optionally heated with the feed gas and is routed to the stripping section of the demethanizer 57 via JT valve 55 as stream 19. Stream 8 is expanded in expander 54 to 300 psig to 450 psig, forming stream 9, typically at −90° F. Stream 9 is then split into two portions, streams 23 and 3, with stream 23 being between 0 and 100% of stream 9, wherein the split ratio is controlled by temperature control device 60 that is coupled to a thermal sensor 61 (typically in the top three, and more typically top five trays) and a flow control device (e.g., control valve). Most typically, the temperature control device includes one or more temperature sensors that are in thermal communication with the upper section 57U of the absorber and is set by the CO2 freezing temperature in the absorber (CO2 freezing is most typically indicated by high pressure drop on the tray section). The sensors are operationally coupled to a control circuit that regulates the flow ratio between 3 and 23, wherein that ratio is a function of the temperature. Stream 3 is routed to the reflux exchanger 50 and heated by about 5° F. to 20° F. to form stream 4 by heat exchange with feed gas stream 7. Stream 23 is combined with the heated expander discharge stream 4 to form stream 24, which is typically at about −70° F. to −85° F. Stream 24 is then fed to the upper section of the demethanizer 57. The cooled feed gas stream 10 leaving exchanger 50 has a temperature of about −100° F. or lower, wherein the refrigeration content for the cooling is provided by the demethanizer overhead stream 13 and the expander discharge stream 3. Further cooling of stream 10 is achieved by JT valve 56, forming JT-expanded reflux stream 11, which is fed to the top of the demethanizer 57.

It is generally preferred that the split ratio of streams 3 and 23 of the expander discharge is controlled using temperature control system 60 with a temperature sensing element located in the demethanizer trays as depicted in FIG. 1. Alternatively, or additionally, the temperature control set-point can also be manually adjusted as necessary to avoid $CO_2$ freezing and improve recovery. It should be noted that increasing the expander discharge flow to the reflux exchanger increases the demethanizer temperature in the upper section, which effectively strips $CO_2$ from the tray liquids while eliminating $CO_2$ freezing problems. At the same time, the additional cooling available from the increased flow to the reflux exchanger subcools stream 7 to an even lower temperature to about −100° F.

The demethanizer column is reboiled with feed gas heat content via stream 21 and a bottom reboiler 58 using external heat, controlling the methane content in the bottom at about 1 to 2 wt % and the $CO_2$ content at about 2 to 5 mol % and lower. The demethanizer 57 produces an overhead vapor stream 13 at −125° F. and 300 psig to 450 psig, and a bottom stream 12 at 50° F. to 80° F. The refrigerant content of the demethanizer overhead vapor is recovered by chilling the feed gas in exchanger 50. The warn residue gas stream 14 is compressed by re-compressor 53 driven by expander 54 to about 600 psig and is further compressed by residue gas compressor 59 to about 600 to 1260 psig or as needed for pipeline transmission. The residue gas compressor discharge stream 16 is cooled by ambient cooler 60, forming stream 17 to the sales gas pipeline. Optionally, the compressed residue gas compressor prior to the ambient cooler supplies at least a portion of the demethanizer reboiler duty.

Figure 2:
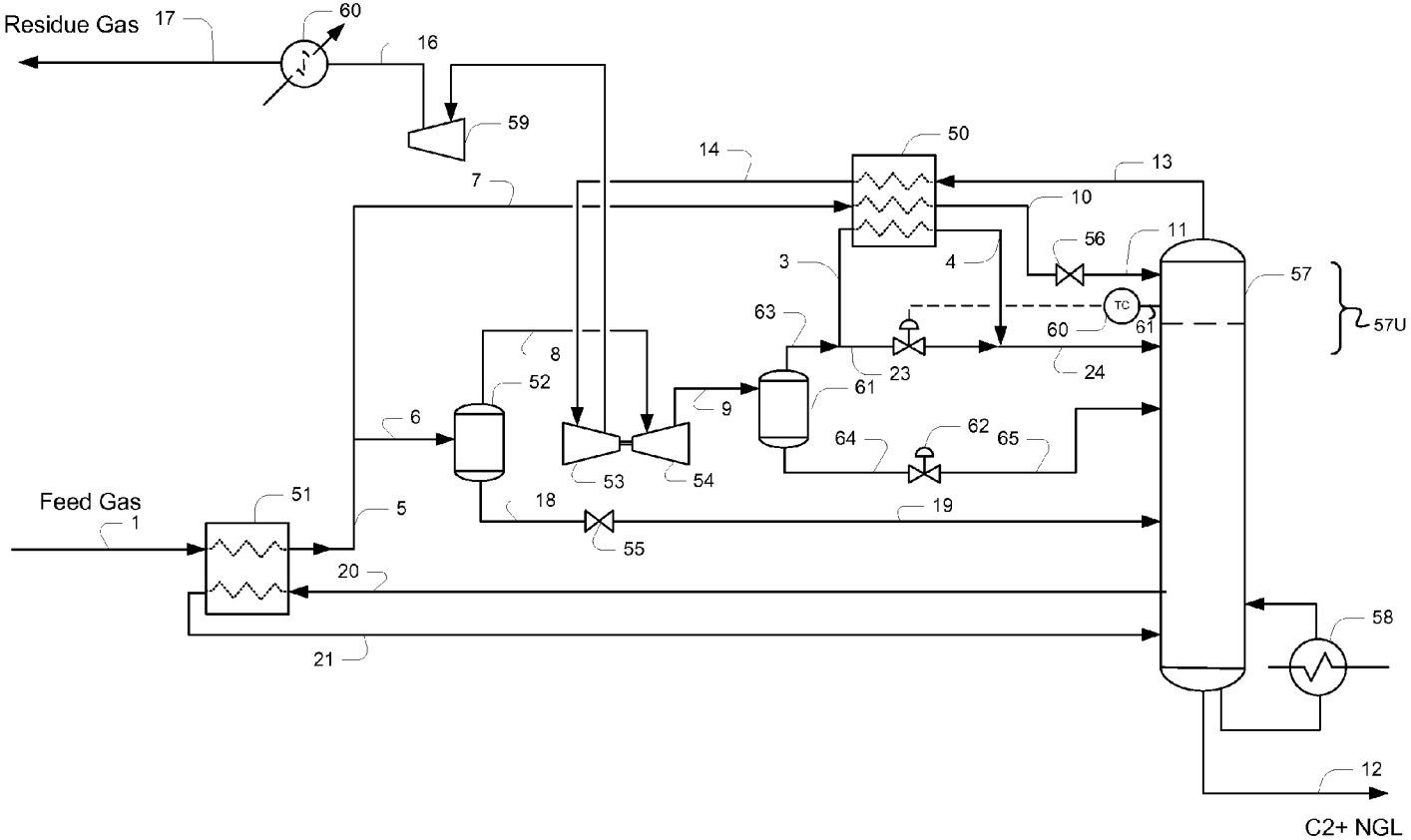
FIG. 2 is a schematic diagram of another exemplary ethane recovery plant.

Another exemplary configuration is depicted in FIG. 2 that is particularly suitable for processing gas with higher $C_2$+ contents. In this configuration, the expander discharge stream 9 (typically a two phase stream) is separated in separator 61 into liquid stream 64 and vapor stream 63. The vapor stream is routed and heated in reflux exchanger 50 as in the previous configuration for controlling $CO_2$ freezing in the demethanizer while the liquid stream is routed via control valve 62 and fed as stream 65 to the stripping section of the demethanizer.

With respect to the remaining components and numerals in FIG. 2, the same considerations for same components and numerals of FIG. 1 apply.

Figure 3:
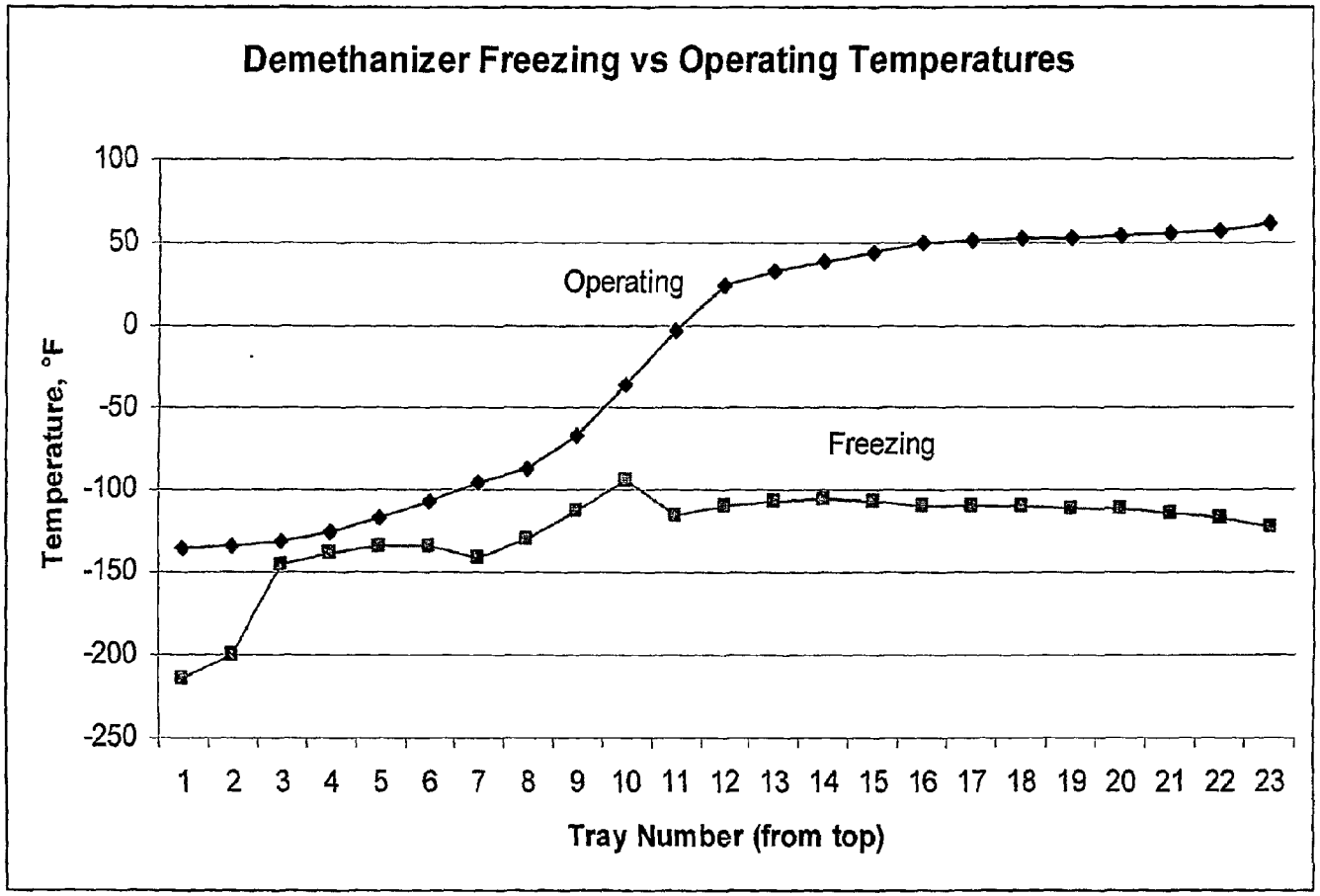
FIG. 3 is an exemplary plot of $CO_2$ freezing temperatures versus operating temperatures of the demethanizer in a plant according to FIG. 1.
Figure 4:
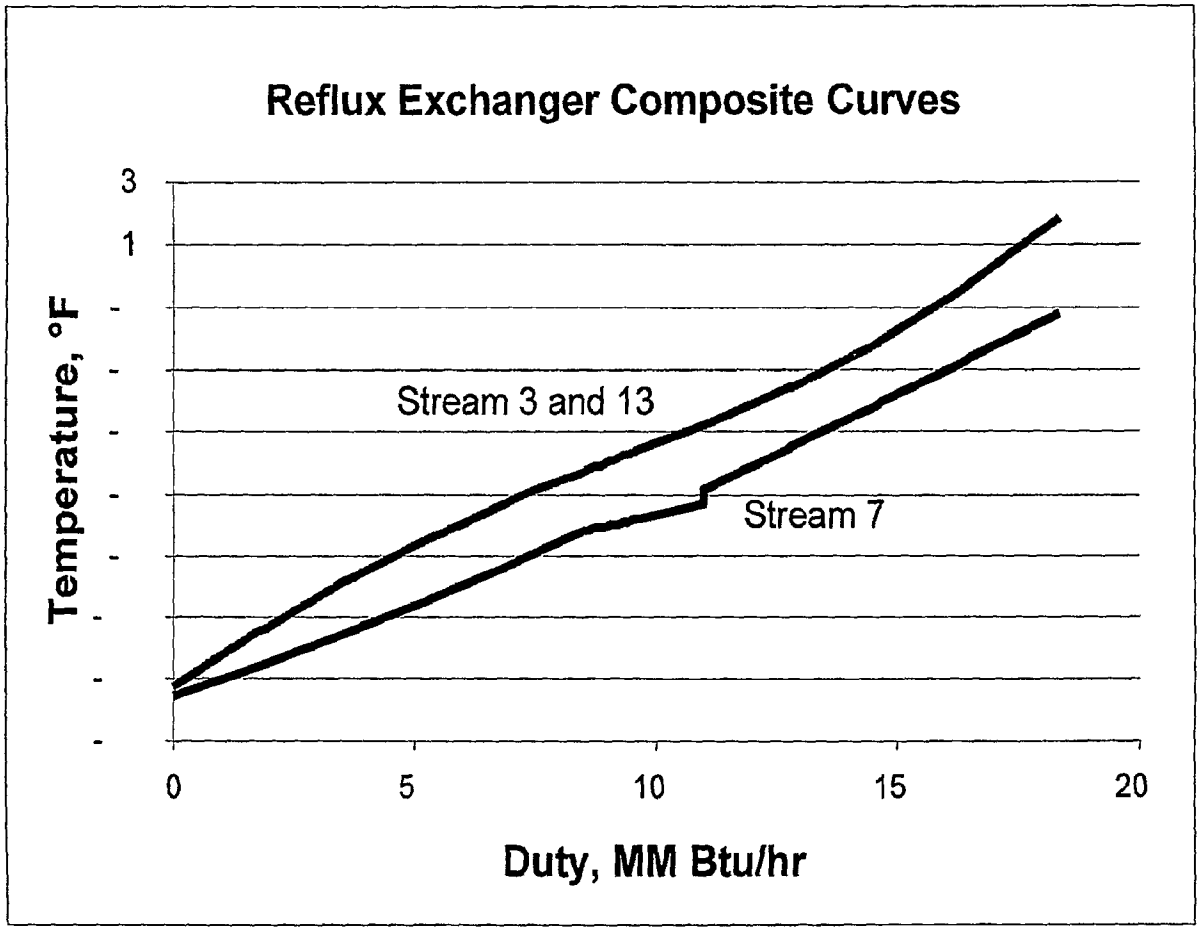
FIG. 4 is an exemplary plot of composite heat exchange curves of the demethanizer reflux exchanger in a plant according to FIG. 1.

Exemplary $CO_2$ freezing temperatures and demethanizer operating temperatures in the configuration of FIG. 1 are plotted in FIG. 3. As can been readily seen, the minimum temperature approach to $CO_2$ freezing occurs at tray 4 in the demethanizer, and by injecting the warm expander discharge to tray 5, the temperature approach to $CO_2$ freezing can be increased by at least 5° F. and more preferably at least 15° F. The composite heat exchange curves of the demethanizer overhead vapor 13, the expander discharge 3, and the (vapor) portion of the feed gas 7 used for reflux are plotted in FIG. 4. As can been seen, the use of the refrigeration content in the expander stream 3 discharge avoids the temperature pinches in the heat exchanger curves that commonly occur in heretofore known expander processes. Table 2 compares the energy consumption of heretofore known NGL plants and processes to configurations according to the inventive subject matter.

| | Prior NGL Processes | Contemplated Process |
|---|---|---|
| Ethane Recovery, % | 89 | 89 |
| C2 Production, BPD | 42000 | 42000 |
| Compression Horsepower: | | |
| Re-compressor, MW | 50 | 43.4 |
| Propane Refrigeration, MW | 8.8 | 5.0 |
| Total Compression Power, MW | 58.8 | 48.4 |
| Heating and Cooling Duties: | | |
| Hot Oil, MM Btu/hr | 35 | 19 |
| Air Coolers, MM Btu/hr | 250 | 129 |
| $CO_2$ in C2, mol % | 6 | >6 |
| Approach to $CO_2$ Freezing, ° C. | 2 | 7.4 |

For example, as can be seen from the table above, to achieve 89% ethane recovery and produce 42,000 BPD of ethane, conventional processes most frequently use a lean oil (such as propane and heavier) to sponge the demethanizer to avoid $CO_2$ freezing problems. In contrast, contemplated process achieve about 20% electric power savings, 20% fuel savings due to reduced hot oil consumption for reboilers, and 50% savings due to reduced air cooling duties.

It should be especially recognized that contemplated configurations and methods allow to achieve two heretofore irreconcilable features (i.e., increase in column temperature in top trays to avoid freezing of $CO_2$ and decrease in column overhead temperature to increase ethane recovery) while reducing power consumption. As more of the expander discharge is heated in the reflux exchanger using the reflux portion of the feed gas vapor, the reflux portion receives extra cooling from the expander discharge. Temperature control is preferably implemented using bypass stream 23 in conjunction with a conventional temperature control device. Since the reflux stream (and with that the top of the demethanizer) is at significantly lower temperature after JT (or other suitable device, including hydraulic turbines, power recovery turbines and expansion nozzles, etc.) expansion, recompression of the demethanizer overhead is more efficient and therefore less power consuming. Viewed from a different perspective, it is preferred that the column overhead product and the expander discharge act as a refrigerant in at least one (preferably integrated) heat exchanger, in which the demethanizer overhead product cools at least a portion of the feed gas and/or separated vapor portion of the expander discharge. Furthermore, it should be appreciated that column configuration for the demethanizer may vary depending on the particular configurations. However, it is generally preferred that the column is configured as a tray type or packed bed type column.

The expander discharge temperature is preferably controlled by any control system that can control the flow ratio between streams 3 and 23 as a function of the tray temperature in the demethanizer. Similarly, control of the flow ratio between streams 6 and 7 may be done in an automated fashion (e.g., via the control system that controls the flow ratio between streams 3 and 23), or at least temporarily in a manual fashion. Typically, the composition of the feed gas will determine the ratio between streams 6 and 7, and optionally further influence the ratio between streams 3 and 23. The cooling requirement for the column is at least in part provided by the reflux stream and the expander discharge, while the $CO_2$ content in the NGL product can be economically reduced to lower levels, e.g. 5 mol % and less, thus eliminating further $CO_2$ separation steps. With respect to the $C_2$ recovery, it is contemplated that such configurations provide at least 70%, more typically at least 80%, and most typically at least 95% ethane recovery. Further considerations are provided in our International patent applications WO 2005/045338 and WO 03/100334, both of which are incorporated by reference herein.

Thus, specific embodiments and applications of ethane recovery methods and configurations for high carbon dioxide content feed gases have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A processing plant for ethane recovery from a carbon dioxide-containing feed gas comprising:

a control circuit that is operationally coupled to (1) a thermal sensor that is thermally coupled to a refluxed demethanizer and (2) a flow control element;

an expander that is coupled to the refluxed demethanizer and a heat exchanger such that (a) the expander provides a first portion of an expander discharge stream to the heat exchanger to thereby form a heated expander discharge stream, (b) the expander provides a second portion of the expander discharge stream to the heated expander discharge stream to thereby form a temperature-controlled expander discharge, and (c) the temperature-controlled expander discharge is provided to the refluxed demethanizer;

wherein the control circuit is configured such that the flow control element controls a flow ratio between the first and second portions of the expander discharge stream in response to a temperature sensed by the thermal sensor in the demethanizer such that the flow ratio is effective to increase a temperature in an upper section of the refluxed demethanizer while providing cooling to a portion of the carbon dioxide-containing feed gas; and wherein the heat exchanger is configured to form a subcooled stream from the portion of the carbon dioxide-containing feed gas for delivery to the demethanizer using refrigeration content of the first portion of an expander discharge.

2. The processing plant of claim 1 wherein the thermal sensor is located within the upper section of the demethanizer.

3. The processing plant of claim 1 further comprising a separator that is fluidly coupled between the expander and the demethanizer such that the expander discharge stream is a vapor portion of an expander discharge.

4. The processing plant of claim 3 wherein the separator is further configured to provide a liquid stream to the demethanizer.

5. The processing plant of claim 1 wherein the heat exchanger is further configured to use refrigeration content from an absorber overhead product to cool the portion of the carbon dioxide-containing feed gas.

6. The processing plant of claim 5 wherein the heat exchanger is configured to allow cooling of the portion of the carbon dioxide-containing feed gas from a temperature of between −20° F. and 50° F. to a temperature of −100° F.

7. The gas processing plant of claim 5 further comprising a pressure reduction device that further reduces temperature of the cooled portion of the carbon dioxide-containing feed gas to thereby form a subcooled reflux stream to the refluxed demethanizer.

8. The processing plant of claim 1 further comprising a primary exchanger that is configured to chill the carbon dioxide-containing feed gas to a temperature of between −20° F. and 50° F.

9. A method of recovering ethane from a carbon dioxide-containing feed gas comprising:

providing a control circuit and operationally coupling the control circuit to a thermal sensor that is thermally coupled to a refluxed demethanizer and to a flow control element;

feeding a temperature-controlled expander discharge to the refluxed demethanizer;

wherein the temperature-controlled expander discharge is formed from a combination of first and second portions of an expander discharge stream, and wherein the first portion of the expander discharge stream is heated in a heat exchanger prior to forming the combination;

configuring the control circuit such that the flow control element controls a flow ratio between the first and second portions of the expander discharge stream in response to a temperature sensed by the thermal sensor in the demethanizer such that the flow ratio is effective to increase a temperature in an upper section of the refluxed demethanizer while providing cooling to a portion of the carbon dioxide-containing feed gas; and configuring the heat exchanger to form a subcooled stream for the refluxed demethanizer using refrigeration content of the first portion of the expander discharge stream, wherein the subcooled stream is a portion of the carbon dioxide-containing feed gas.

10. The method of claim 9 wherein the thermal sensor is located within an upper section of the demethanizer.

11. The method of claim 9 further comprising a step of fluidly coupling a separator between an expander and the demethanizer such that the expander discharge stream is a vapor portion of an expander discharge.

12. The method of claim 11 wherein the separator further provides a liquid stream to the demethanizer.

13. The method of claim 9 wherein the heat exchanger cools the portion of the carbon dioxide-containing feed gas from a temperature of between −20° F. and 50° F. to a temperature of −100° F.

14. The method of claim 9 wherein a pressure reduction device reduces temperature of the cooled portion of the carbon dioxide-containing feed gas to thereby form a subcooled reflux stream to the refluxed demethanizer.

15. The method of claim 9 wherein a primary exchanger chills the carbon dioxide-containing feed gas to a temperature of between −20° F. and 50° F.

* * * * *